US012296242B1

(12) United States Patent
Shields

(10) Patent No.: US 12,296,242 B1
(45) Date of Patent: May 13, 2025

(54) GOLF BELL

(71) Applicant: Robert L. Shields, Cape Coral, FL (US)

(72) Inventor: Robert L. Shields, Cape Coral, FL (US)

( * ) Notice: Subject to any disclaimer, the term of this patent is extended or adjusted under 35 U.S.C. 154(b) by 1122 days.

(21) Appl. No.: 16/950,867

(22) Filed: Nov. 17, 2020

Related U.S. Application Data

(60) Provisional application No. 62/936,598, filed on Nov. 17, 2019.

(51) Int. Cl.
*A63B 57/40* (2015.01)
*A63B 57/30* (2015.01)
*A63B 71/06* (2006.01)

(52) U.S. Cl.
CPC ..... *A63B 57/40* (2015.10); *A63B 57/357* (2015.10); *A63B 71/0622* (2013.01); *A63B 2071/0633* (2013.01); *A63B 2071/0694* (2013.01)

(58) Field of Classification Search
CPC ... A63B 57/40; A63B 57/357; A63B 71/0622; A63B 2071/0633; A63B 2071/0694
See application file for complete search history.

(56) References Cited

U.S. PATENT DOCUMENTS

| | | | |
|---|---|---|---|
| 1,136,708 | A | 4/1915 | Osborn |
| 2,789,823 | A | 4/1957 | Bennett |
| 3,602,516 | A | 8/1971 | Doherty |
| 4,007,938 | A | 2/1977 | Guenther |
| 5,145,178 | A | 9/1992 | Ropars |
| 5,306,013 | A | 4/1994 | Germinario |
| 7,147,567 | B2 | 12/2006 | Yu |
| 2006/0089205 | A1 | 4/2006 | Yu |
| 2013/0045821 | A1 | 2/2013 | Dugdale |
| 2017/0312604 | A1 | 11/2017 | O'Loughlin |

FOREIGN PATENT DOCUMENTS

| | | | | |
|---|---|---|---|---|
| JP | 11151333 | H | | 6/1999 |
| JP | 3160355 | U | | 6/2010 |
| JP | 2012200485 | A | | 10/2012 |
| JP | 3185850 | U | * | 9/2013 |
| JP | 6490294 | B1 | * | 3/2019 |

* cited by examiner

*Primary Examiner* — Jeffrey S Vanderveen
(74) *Attorney, Agent, or Firm* — Albert W. Watkins

(57) ABSTRACT

A golf green is enhanced by sliding a spacer tube and bell onto and circumscribing a flag pole. The spacer tube upper end suspends the bell above the golf green, defining a gap smaller than golf ball diameter. The bell rings when struck by the golf ball. The spacer tube and flag pole reliably locate the bell relative to the green. In some embodiments, the bell is positioned relative to a cup within the hole in the green, while in other embodiments the bell is positioned relative to the green surface. A method of installing a golf bell onto a flag pole having a flag includes disabling a flag on the flag pole, such as by removal of the flag from the pole, slipping a spacer tube about and down the flag pole, followed by a bell until the bell rests on the spacer tube. The flag is subsequently re-enabled.

12 Claims, 5 Drawing Sheets

GOLF BELL

CROSS REFERENCE TO RELATED APPLICATIONS

The present application claims the benefit of U.S. provisional patent application 62/936,598 filed Nov. 17, 2019 of like title and inventorship, the teachings and entire contents which are incorporated herein by reference.

BACKGROUND OF THE INVENTION

1. Field of the Invention

The present invention pertains generally to games, and more particularly to golf. In one preferred manifestation, the present invention slides over an existing golf green flag pole and suspends a bell above the grass by a predetermined distance less than the diameter of a golf ball. When a golf ball hits and thereby rings the bell, the putt is successful.

2. Description of the Related Art

A variety of artisans have devised various bells for use in golf. Several exemplary US and Foreign patents and publications, the teachings and contents of each which are incorporated herein by reference, include: 1,136,708 by Osborn, entitled "Game apparatus"; 4,007,938 by Guenther, entitled "Putting device"; 5,145,178 by Ropars, entitled "Golf game apparatus"; 5,306,013 by Germinario, entitled "Projectile accuracy signalling apparatus"; 7,147,567 by Yu, entitled "Golf training kit for playing on a small course"; 2006/0089205 by Yu, entitled "Golf Training Kit for Playing on a small course"; 2013/0045821 by Dugdale, entitled "Lawn game and components thereof"; JP 2012-200485A by Shigeru et al, entitled "Hole post for ground golf"; JP 3160355U by Nishiguchi, entitled "Hole post for grand golf"; and JP H11151333A by Eiji, entitled "Hole post for ground golf competition". While each of these offer various benefit and advantage for some purposes and applications, they each include highly undesirable legs, stands, or other bases that will interfere with what would have otherwise been a proper and successful putt. In addition, the fabrication of these stands requires unnecessary effort and expense, and undue storage space.

U.S. Pat. No. 3,602,516 by Doherty, entitled "Simulated golf putting hole," and US published patent application 2017/0312604 by O'Loughlin, entitled "Golf Hole Enlargement Device," the teachings and contents of each which are incorporated herein by reference, each provide apparatus that overcome these deficits, though they each serve slightly different purpose from each other. In the golf hole enlargement device of O'Loughlin, a pair of discs are separated from each other by a cylindrical body, overall resembling a wire spool or thread bobbin. The golf green flag passes through the center of the apparatus and into the hole. When a person putts a golf ball toward the hole, the golf hole enlargement device will trap the golf ball. This makes it easier for a person to successfully putt, making a round of golf quicker, easier, and less frustrating for more casual golfers. When not desired, the flag is simply lifted from the hold and golf hole enlargement device, the golf hole enlargement device removed, and the flag returned to the hole. While the golf hole enlargement device of O'Loughlin is again very useful and beneficial, several disadvantages arise. A shot that hits relatively tangent to the golf hole enlargement device will skip off, without clear indication of whether the putt was successful. In contrast, a shot perfectly aimed to the hole will be captured, making removal of the ball somewhat more difficult than would be desirable.

In contrast, Doherty presents a bell suspended on a ground insertion stake. This means that the Doherty invention cannot readily be used with an existing golf green and flag stick.

Nevertheless, the bell is suspended just above the grass, and the flag stick is suspended above the bell by a spring that permits the flag stick to be manipulated to measure distance and thereby determine if a putt was successful.

As may be appreciated, in spite of the extensive thought and creative designs of the prior art, there still remains a need for a bell that may be coupled to an existing hole and flag stick, and which will provide ready indication of a successful stroke while still leaving the ball readily accessible and retrievable at ground level.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is an enhanced golf green. The enhanced golf green has a golf green with golf green earth located beneath the golf green. A golf ball has a golf ball diameter and is configured to roll upon the golf green. A hole is formed through the golf green and within the golf green earth. A cup is inserted into the hole. A longitudinally extensive flag pole defines a flag pole longitudinal axis and has a flag pole top and a flag pole bottom distal to the flag pole top, and a flag pole outside diameter around the flag pole longitudinal axis. A flag is adjacent and affixed to the top of the flag pole. The improvement comprises a golf bell having a longitudinally extensive spacer tube defining a spacer tube longitudinal axis and terminating at a spacer tube upper end and at a spacer tube lower end distal to the spacer tube upper end and a spacer tube outside diameter around the spacer tube longitudinal axis. The spacer tube circumscribes the flag pole. A bell has a bell body circumscribing the flag pole. A bell hole passes through the bell body that is larger in diameter than the flag pole outside diameter and smaller in diameter than the spacer tube outside diameter. The bell is resting upon the spacer tube upper end with the bell hole circumscribing the flag pole and is suspended above the golf green, defining a gap therebetween smaller than the golf ball diameter. The bell is configured to ring and thereby provide an indication that the golf bell has been struck when impacted by the golf ball.

In a second manifestation, the invention is in combination a ground supported golf flag pole and a golf bell. The golf bell comprises a longitudinally extensive spacer tube defining a spacer tube longitudinal axis and terminating at a spacer tube upper end and at a spacer tube lower end distal to the spacer tube upper end and a spacer tube outside diameter around the spacer tube longitudinal axis. The spacer tube circumscribes the golf flag pole, with at least one of the spacer tube and the golf flag pole penetrating the ground. A bell has a bell body circumscribing the golf flag pole. A bell hole passes through the bell body and is larger in diameter than the golf flag pole outside diameter and smaller in diameter than the spacer tube outside diameter. The bell rests upon the spacer tube upper end with the bell hole circumscribing the golf flag pole and is suspended above the ground to define a gap therebetween smaller than the golf ball diameter. The bell is configured to ring and thereby provide an indication that the golf bell has been struck when impacted by a golf ball.

In a third manifestation, the invention is a method of installing a golf bell onto a golf flag pole having a flag. In accord with the method, the flag is disabled relative to the golf flag pole. A spacer tube is slipped about and down the flag pole. A bell is slid about and down the flag pole until it rests on the spacer tube. The flag is re-enabled relative to the flag pole subsequent to the slipping and sliding steps.

OBJECTS OF THE INVENTION

Exemplary embodiments of the present invention solve inadequacies of the prior art by sliding a spacer tube and bell onto a prior art flag pole. The spacer tube locates the bell relative to the green. In some embodiments, the bell is positioned relative to a cup within the hole in green, while in other embodiments the bell is positioned relative to the surface of the green.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a golf bell that will efficiently resonate when struck by a golf ball, thereby indicating a successful stroke. A second object of the invention is to provide such indication of a successful stroke while still leaving the ball readily accessible and retrievable at ground level. Another object of the present invention is to provide a larger and more visible golfing target. A further object of the invention is to provide a bell that may be easily and intuitively coupled to an existing golf green hole and flag stick. Yet another object of the present invention is to provide simple and precise location and spacing of the bell above ground level.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
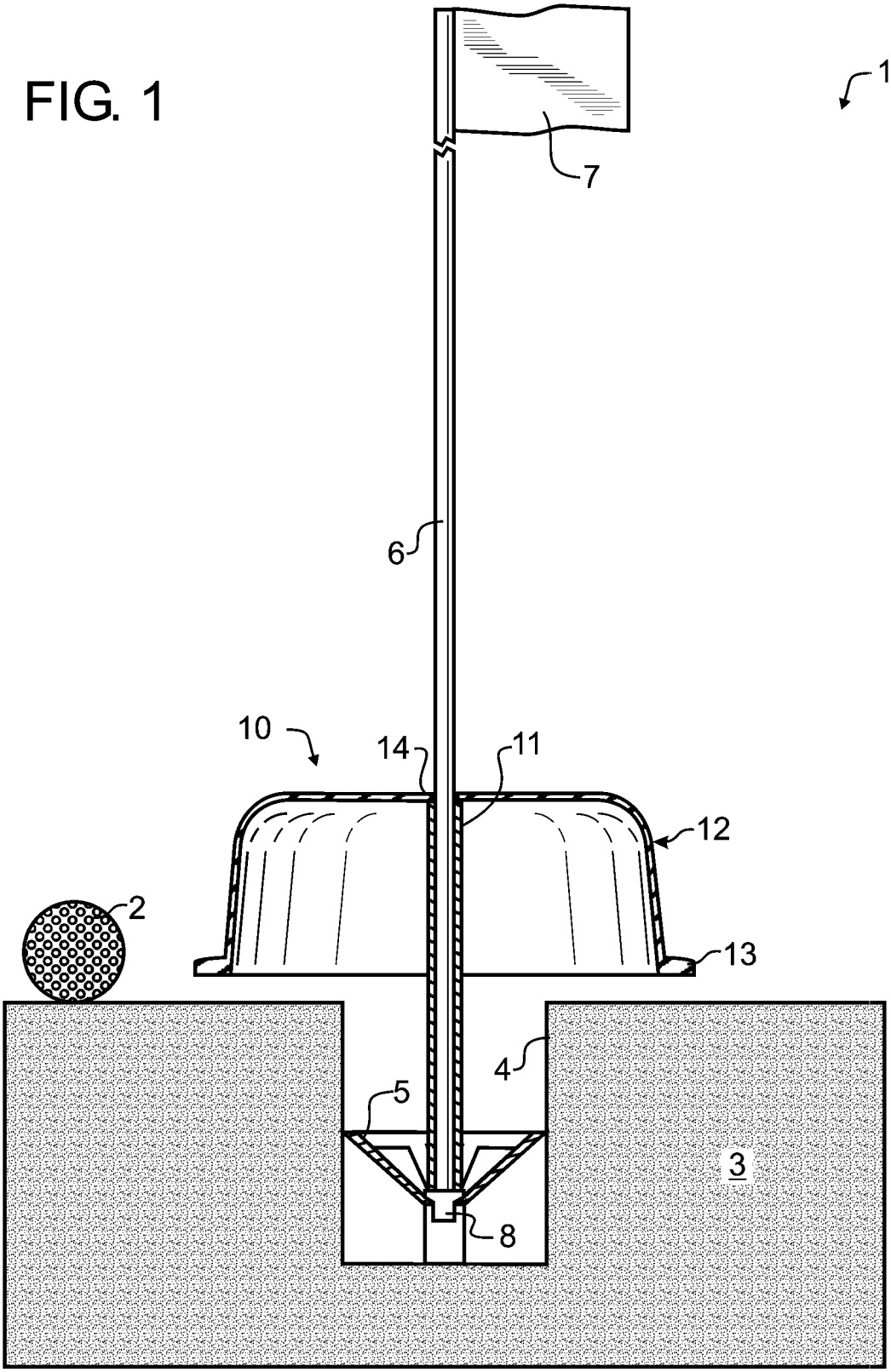
FIG. 1 illustrates a preferred embodiment golf bell designed in accord with the teachings of the present invention in further combination with a prior art golf ball, golf green, hole, and flag from a front elevational view showing each of the spacer tube, bell, green, hole, and cup from a vertical plane section view.
Figure 2:
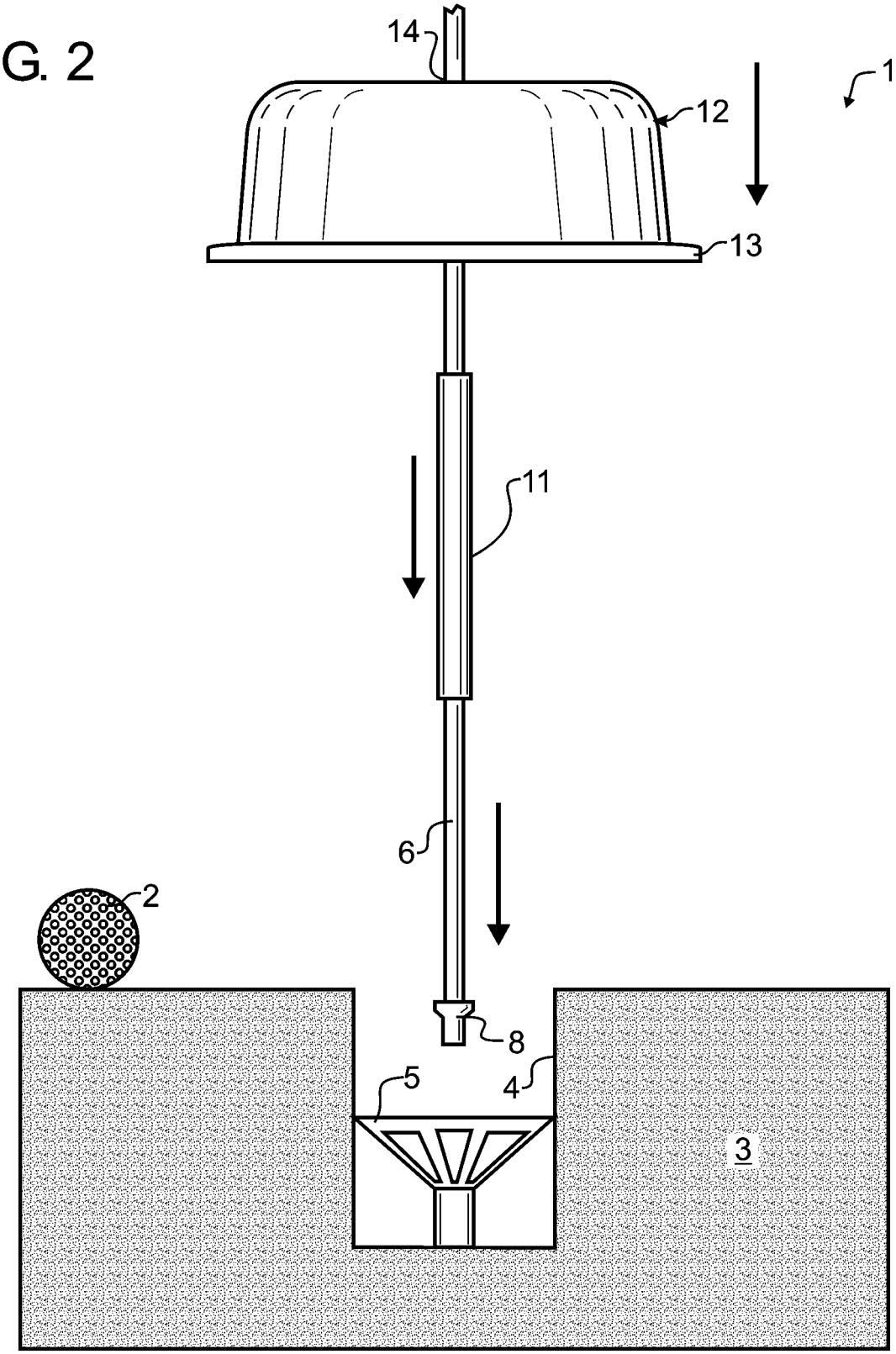
FIG. 2 illustrates one preferred embodiment golf bell of FIG. 1 from a front elevational view showing each of the green and hole from a vertical plane section view, and further showing the flag pole, flag pole ferrule, spacer tube, and bell in offset position intermediate during assembly.

In a preferred embodiment of the invention illustrated in FIGS. 1-2, an enhanced golf green 1 includes a number of well-known and prior art golf components. These include a golf ball 2 resting upon the golf green earth 3, which will typically be covered by the grass of the green. Within the golf green earth 3 is a hole 4 having a cup 5 inserted therein. Within the hole 4 and cup 5 is a flag pole ferrule 8 that terminates the bottom end of a flag pole 6. At or adjacent to the top of flag pole 6 is a flag 7. In accord with the teachings of the present invention, the enhanced golf green 1 further includes a preferred embodiment golf bell 10. Golf bell 10 includes two primary components, a spacer tube 11 and a bell 12. Bell 12 has a bell rim 13 and a bell hole 14 vertically distal to bell rim 13.

As illustrated, bell rim 13 is slightly above golf green earth 3, and positioned so that golf ball 2 when traveling generally toward hole 4 will strike bell rim 13 instead. This collision between golf ball 2 and bell rim 13 will most preferably ring bell 12 to provide a primary indication that preferred embodiment golf bell 10 has been struck.

In preferred embodiment golf bell 10, for reasons that will be further explained and therefore better understood from the assembly process herein below, bell hole 14 is larger in diameter than the outside diameter of flag pole 6, and is smaller in diameter than the outside diameter of spacer tube 11. As a result, in addition to the ringing, bell 12 will also tend to wobble about flag pole 6 subsequent to being struck. This wobble allows a prolonged and undamped resonance of bell 12.

In addition, this wobble provides a secondary visual indication that bell 12 has been struck.

The diameter and geometry of bell 12 will be chosen to meet a variety of criteria. A first and primary criteria is the amplitude and resonance of sound created by impact from golf ball 2. A further criteria is the size and shape of the target created by the profile or section of the bell. When the outer diameter of bell 12 and bell rim 13 are greater than the diameter of hole 4, a person has a greater chance of striking preferred embodiment golf bell 10 than they would have for the ball to fall into hole 4. This can be very useful for primarily entertaining golf outings, such as a team scramble event. In addition, the profile or section as illustrated in FIG. 1 includes a relatively flat top geometry that limits potential contact between golf ball 2 and bell 12 to ground contact or close thereto. In other words, this geometry will still allow airborne balls to either fly over preferred embodiment golf bell 10 or to strike flag pole 6 and bounce off, in either case without ringing bell 12. In contrast, a more traditional bell shape may be used, with the attendant increase in likelihood of impact from airborne golf balls. In addition, in some embodiments, the geometry of bell rim 13 is shaped such that golf ball 2 is redirected from horizontal travel to vertical, thereby being driven up and off of green earth 3 if hit sufficiently hard. This redirection will tend to keep golf ball 2 in close proximity to preferred embodiment golf bell 10.

In some alternative embodiments, the outer diameter of bell 12 and bell rim 13 are less or approximately the same as the diameter of hole 4. In such embodiments, a person has to be more precise to either strike bell 12, or if the diameter is much less, to be able to get the ball to at least partially enter into hole 4.

FIG. 2 illustrates a preferred installation process used to install preferred embodiment golf bell 10 onto a prior art flag pole 6 having a flag 7. Flag 7 will preferably be diminished or disabled, such as by removal from flag pole 6. In those instances where flag 7 is not removable, flag 7 may instead be diminished or disabled by other techniques, including for exemplary and non-limiting purpose wrapping relatively tightly about flag pole 6 and preferably securing such as with removable tape. Then spacer tube 11 is slid down flag pole 6 as shown in FIG. 2, until it rests on flag pole ferrule 8 as shown in FIG. 1. In a similar procedure, bell 12 is slid down flag pole 6 as shown in FIG. 2, until it rests on spacer tube 11. Flag 7 is then re-enabled. If flag 7 was removed, enabling is a matter of reattaching. Finally, flag pole ferrule 8 is inserted into cup 5 in the usual manner. As may be appreciated, preferred embodiment golf bell 10 is quickly and easily installed and later quickly and easily removed from a golf course.

In order for spacer tube 11 and bell 12 to slide over flag pole 6, they must each have an inside diameter greater than the outside diameter of flag pole 6. It is this requirement that leads to the wobble of bell 12 described herein above when struck by golf ball 2. However, in some alternative embodiments golf bell 10 may be pre—or factory-installed onto a flag pole 6, or otherwise affixed to create a tight and secure fit between bell 12 and flag pole 6.

Particularly when a highly reflective and corrosion resistant material is used for the material or surface coating of bell 12, the wobble will provide additional visual indication of successful stroke in combination with sound, even visible at great distance. This may be exemplified by the flashing of reflection of sun off of the reflective material of bell 12. In further embodiments, special coatings are provided that produce highly changing visual pattern depending upon viewing angle, thereby enhancing visual acuity to strike and wobble.

In some alternative embodiments, other types of indicators may be used in combination or alternatively to the aforementioned bell ringing sound and visual wobble. For exemplary and non-limiting purposes only, in some alternative embodiments a sound activated detector having microphone, or other types sound or vibratory detection, magnetic or optical detection of wobble, and the like are incorporated. In such case a further secondary indicator is activated, again for exemplary and non-limiting purpose such as for a brief few second interval, with light or other type of secondary indication. Further alternative embodiments incorporate an electrical solenoid or other actuator to very forcefully strike bell 12 when a primary ringing from golf ball impact is detected, in the manner of a gong.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 3:
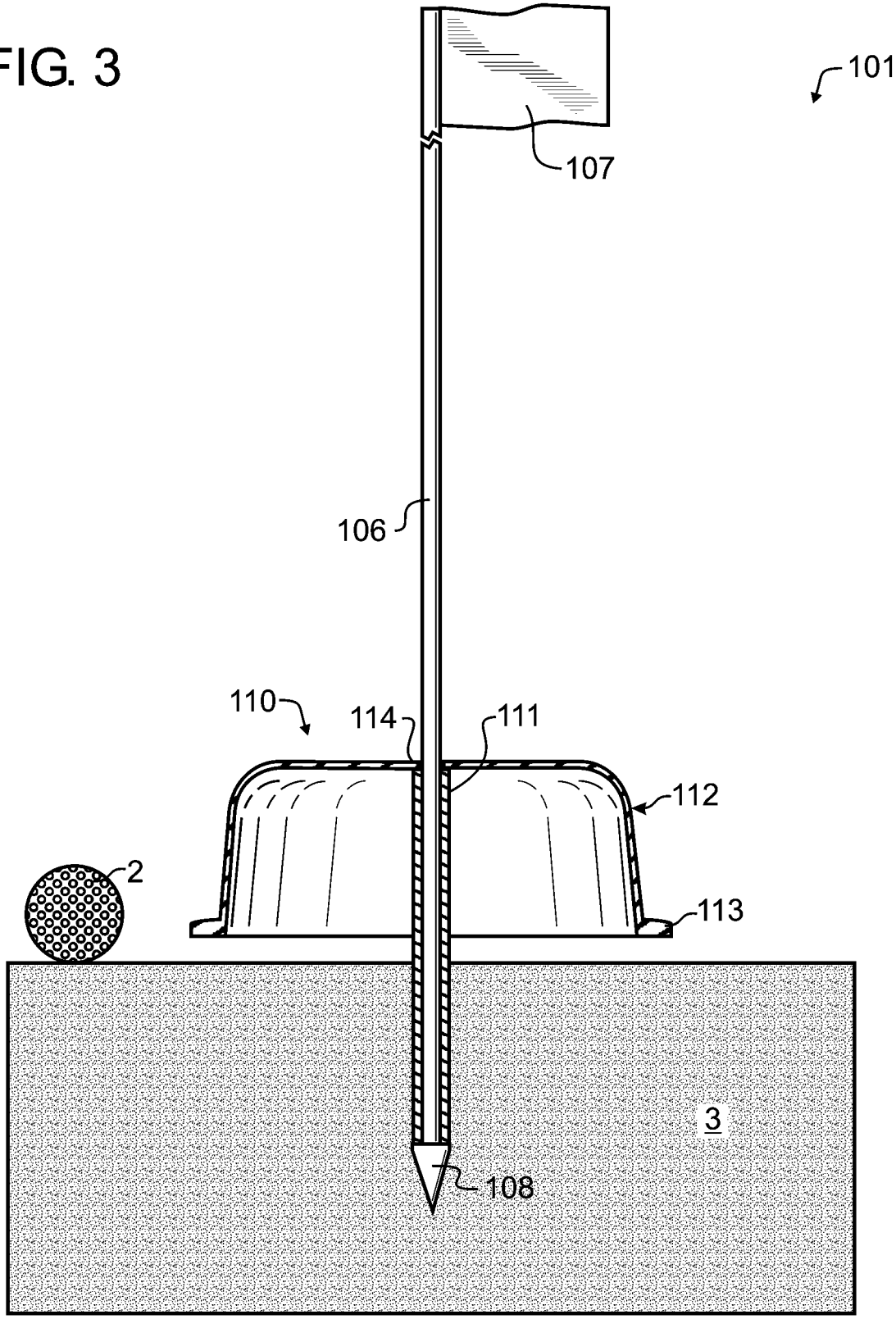
FIG. 3 illustrates an alternative embodiment golf bell designed in accord with the teachings of the present invention in further combination with a prior art golf ball, golf green, and flag from a front elevational view showing each of the spacer tube, bell, and green from a vertical plane section view.

A first alternative embodiment enhanced golf green 101 is illustrated in FIG. 3 that has been configured for use without presence of a hole 4 or cup 5. To accommodate this change, flag pole 106 terminates at a ground insertion point that penetrates directly into the earth 3. In some embodiments, this ground insertion point is the bottom of flag pole 106 and/or spacer tube 111, which is cut in a plane perpendicular to their longitudinal axis or at an angle therewith to create a point. As illustrated, an optional flag pole point 108 has been provided. In this alternative embodiment golf bell 110, the diameter of bell hole 114 may be selected to either provide wobble, or to instead tightly circumscribe flag pole 106.

Figure 4:
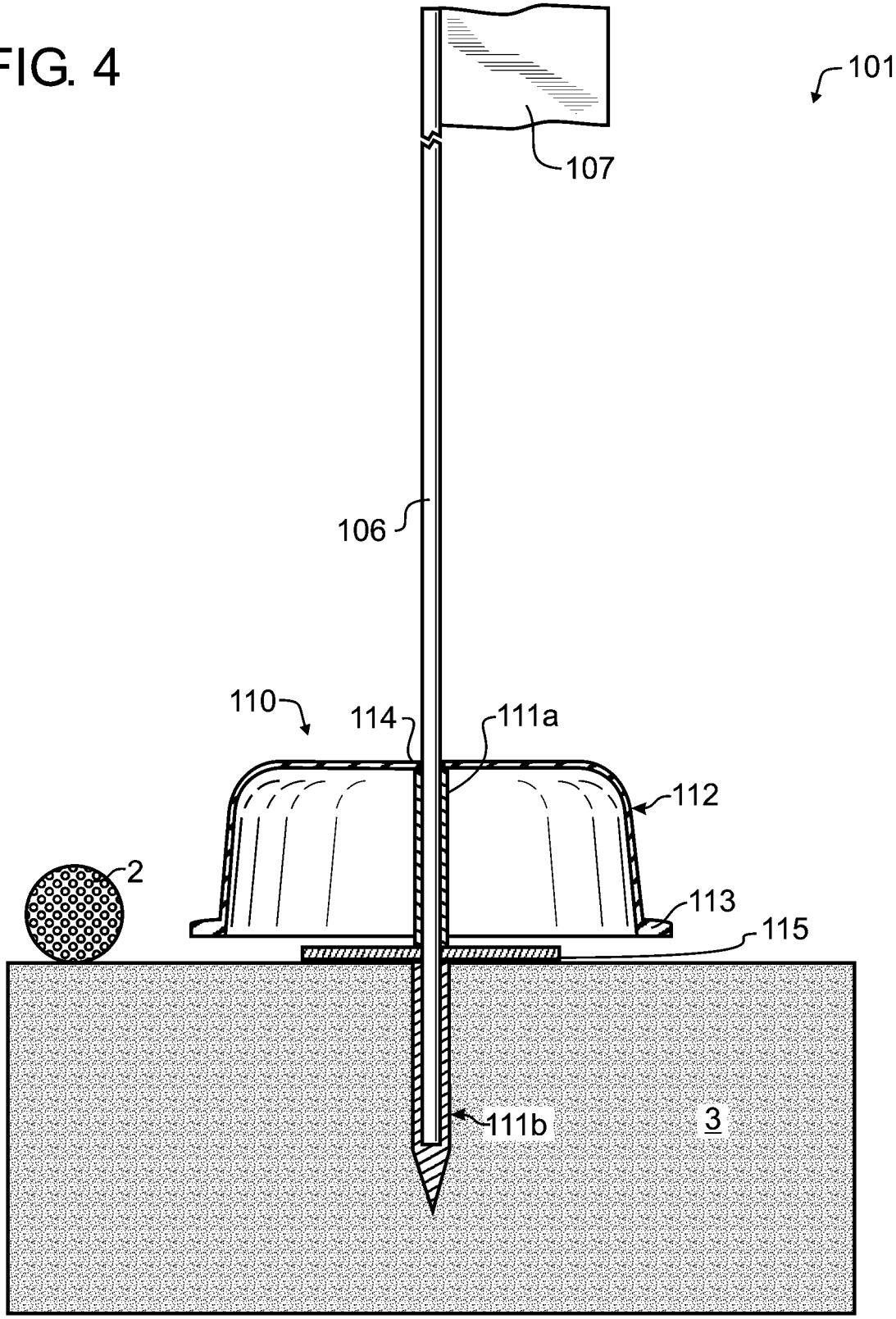
FIG. 4 illustrates a second alternative embodiment golf bell designed in accord with the teachings of the present invention in further combination with a prior art golf ball, golf green, and flag from a front elevational view showing each of the spacer tube, bell, and green from a vertical plane section view.

FIG. 4 illustrates an alternative embodiment spacer tube that has been divided into two portions, an above ground spacer tube 111*a* and a ground-inserted tube 111*b*. Ground-inserted tube 111*b* as illustrated may for exemplary and non-limiting purpose be fabricated with a closed ground-piercing point, but in alternative embodiments will instead be fabricated from a sleeve or tube open on both ends, and may take any geometry suitable to provide the necessary support for flag pole 106. In such alternative embodiments, ground-inserted tube 111*b* is in some embodiments cut in a plane perpendicular to the longitudinal axis and in other embodiments cut or otherwise formed at an angle therewith to create a point. Rather than pierce the earth as spacer tube 111 does, spacer tube 111*a* instead rests upon a spacer washer 115 that will rest upon the surface of earth 3. In turn, bell 12 will rest upon spacer tube 111*a*. In this way, spacer tube 111*a* will very precisely locate bell 112 a predetermined distance above the earth. A particular advantage of this configuration over that of spacer tube 111 of FIG. 3 is that a person may quickly place golf bell 110 onto the ground without the need to measure the depth of insertion, instead relying upon spacer washer 115 and spacer tube 111*a* to establish proper spacing thereto.

In use, ground-inserted tube 111*b* will be inserted into the earth 3 entirely by hand or using any tools suitable for a particular soil type. Once inserted, and if so desired, ground-inserted tube 111*b* may be left in the earth 3 semi-permanently. This means that a person such as a home-owner can easily remove the flag pole(s) 106 and golf bell(s) 110. In such case, and as long as ground-inserted tube 111*b* terminates very close to the surface of earth 3, there will not be any obstacles or obvious visual evidence of the golf bell 110 or flag pole 106, until the next time the home-owner wishes to set up. At that next time, the home-owner may quickly insert the flags and bells, knowing they are already properly positioned.

While spacer tube 111*a* is illustrated as being tubular or pipe-shaped, in some alternative embodiments the wall thickness of spacer tube 111*a* may be greatly increased to provide more positive engagement with the surface of earth 3. In other embodiments, either or both ends of spacer tube 111*a* may have an enlarged outer diameter, similarly providing more positive engagement with the surface of earth 3. Similar to ground-inserted tube 111*b*, spacer tube 111*a* as illustrated is cylindrical, but in alternative embodiments will, for exemplary and non-limiting purpose, be fabricated with any geometry suitable to provide the necessary support for golf bell 110. In addition, while spacer tube 111*a*, ground-inserted tube 111*b*, and spacer washer 115 are each illustrated as separate components, in some alternative embodiments one or more of these components are combined to form unitary components. For exemplary and non-limiting purpose, in some alternative embodiments ground-inserted tube 111*b* and spacer washer 115 are fabricated as a single unitary component. In other alternative embodiments, spacer tube 111*a* and spacer washer 115 are fabricated as a single unitary component. In yet other alternative embodiments, spacer tube 111*a*, spacer washer 115, and ground-inserted tube 111*b* are all fabricated as a single unitary component, though incorporating all three as a single unitary component is less desirable, since such construction presents an obstacle if left in the earth semi-permanently.

Figure 5:
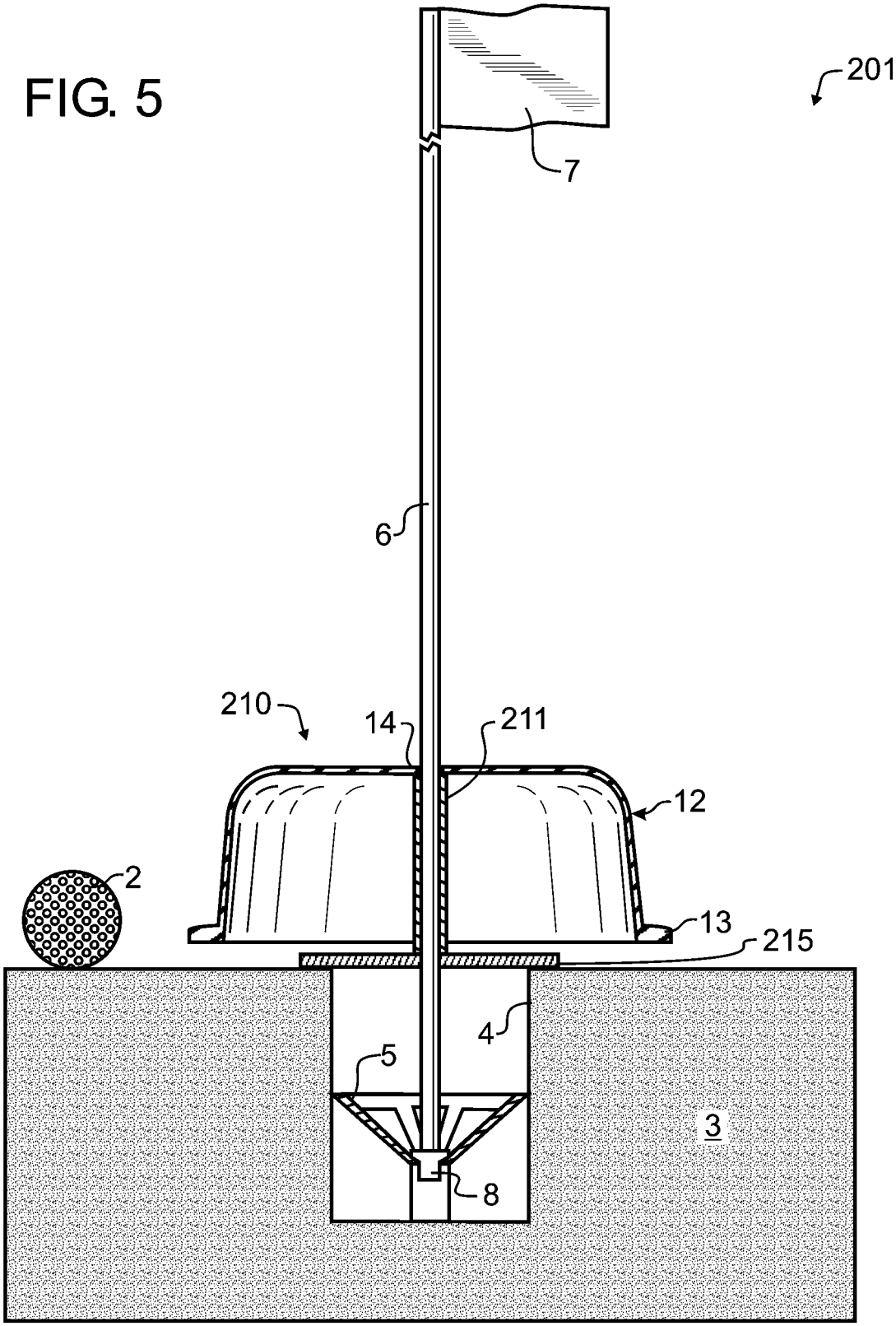
FIG. 5 illustrates a third alternative embodiment golf bell designed in accord with the teachings of the present invention in further combination with a prior art golf ball, golf green, hole, and flag from a front elevational view showing each of the spacer washer, spacer tube, bell, green, hole, and cup from a vertical plane section view.

FIG. 5 illustrates an enhanced golf green 201 having a third alternative embodiment golf bell 210. Like preferred embodiment golf bell 10, golf bell 210 is slid onto a prior art flag pole 6 that is inserted into a prior art cup 5, using a flag pole ferrule 8 to engage with cup 5. While the holes in a golf course are intended to be of consistent depth, not all golf courses have such reliable depth holes. In such cases the spacing between preferred embodiment golf bell 10 and the surface of earth 3 will vary, and can lead to unacceptable spacing therebetween. To eliminate variability due to hole depth, golf bell 210 includes a spacer washer 215 that has an outside diameter larger than the diameter of hole 4, so that spacer washer 215 will rest upon the surface of earth 3. In addition, the inside diameter of spacer washer 215 (meaning the hole within washer 215) will have a diameter similar to that of spacer tube 211 and bell hole 14. As a result, spacer washer 215 will rest upon the surface of earth 3, spacer tube 211 will rest upon spacer washer 215, and bell 12 will rest upon spacer tube 211. As with preferred embodiment golf bell 10, bell 12 will preferably be free to ring and wobble on top of spacer tube 211. While as illustrated in FIG. 5 spacer washer 215 has an outside diameter smaller than the inside diameter of bell rim 13, in some alternative embodiments the outside diameter of spacer washer 215 may be equal to or even slightly larger than the inside diameter of bell rim 13. In such alternative embodiments, spacer washer 215 will be fabricated from a material that may further increase the amplitude of or otherwise alter the sound of bell 12 ringing, if bell 12 wobbles sufficiently to make contact with spacer washer 215.

From the foregoing figures and description, several additional features and options become more apparent. First of all, golf bells 10, 110, 210 may be manufactured from a variety of materials, including metals, resins and plastics, ceramics or cementitious materials, or even combinations or composites of the above. The specific material used may vary, though special benefits are attainable if several important factors are taken into consideration. Bell metal alloys, usually a high tin content bronze containing a majority copper and minority of tin, provide ideal sound generation. In some alternative embodiments, small quantities of other metals or materials may further be incorporated therein. When relatively unweathered, such alloys will also provide desirable reflectivity.

Furthermore, it is preferable that all materials are sufficiently tough and durable to not fracture, even when great forces are applied thereto. In addition, the materials will most preferably be suitable for exterior use on a golf course. In the case of spacer tubes 11, 111, 111*a*, 111*b*, 211, a preferred material is PVC tubing, owing to light weight, low cost, and ready availability, though many other materials will be suitable.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. An enhanced golf green, having:

a golf green;

golf green earth beneath said golf green;

a golf ball having a golf ball diameter and configured to roll upon said golf green;

a hole formed through said golf green and within said golf green earth;

a cup inserted into said hole;

a longitudinally extensive flag pole defining a flag pole longitudinal axis and having a flag pole top and a flag pole bottom distal to said flag pole top, and a flag pole outside diameter around said flag pole longitudinal axis; and a flag adjacent and affixed to said top of said flag pole;

wherein the improvement comprises a golf bell having:

a longitudinally extensive spacer tube defining a spacer tube longitudinal axis and terminating at a spacer tube upper end and at a spacer tube lower end distal to said spacer tube upper end and a spacer tube outside diameter around said spacer tube longitudinal axis, said spacer tube circumscribing said flag pole;

a bell having a bell body circumscribing said flag pole; and a bell hole passing through said bell body that is larger in diameter than said flag pole outside diameter and smaller in diameter than said spacer tube outside diameter;

said bell resting upon said spacer tube upper end with said bell hole circumscribing said flag pole and suspended above said golf green and defining a gap therebetween smaller than said golf ball diameter; and said bell configured to ring and thereby provide an indication that said golf bell has been struck when impacted by said golf ball;

wherein said bell has a bowl shape, and a rim distal to said bell hole; and wherein said rim has a diameter greater than a diameter of said hole and is configured to block said golf ball from entering into said hole.

2. The enhanced golf green of claim 1, wherein said rim has a diameter less than a diameter of said hole and is configured to allow said golf ball to partially enter into said hole.

3. The enhanced golf green of claim 1, wherein said bell rim is configured to redirect said golf ball from horizontal travel across said golf green to include a vertical component, thereby lifting said golf ball up and off of said golf green upon sufficient impact velocity with said bell rim.

4. The enhanced golf green of claim 1, wherein said bell is configured to wobble about said flag pole when impacted by said golf ball, said wobble simultaneously providing both of a visual indication of said golf ball impact and a prolonged and undamped resonance of said bell responsive to said golf ball impact.

5. The enhanced golf green of claim 1, wherein said bell further comprises a substantially flat top.

6. A method of installing a golf bell onto a golf flag pole having a flag, comprising the steps of:

disabling said flag relative to said golf flag pole;

slipping a spacer tube about and down said golf flag pole;

sliding a bell about and down said golf flag pole until it rests on said spacer tube;

re-enabling said flag relative to said golf flag pole subsequent to said slipping and sliding steps; and moving a spacer washer about and down said golf flag pole prior to said slipping and sliding steps;

wherein said spacer washer is moved into and rests upon a golf green and spans a golf hole cup, said spacer tube rest upon spacer washer, and said bell rests upon said spacer tube subsequent to said slipping, sliding, and moving steps.

7. The method of installing a golf bell onto a golf flag pole of claim 6, wherein said slipping step further comprises slipping said spacer tube about and down said golf flag pole until said spacer tube rests on a flag pole ferrule distal to said flag.

8. The method of installing a golf bell onto a golf flag pole of claim 7, further comprising the step of inserting said flag pole ferrule into a golf hole cup.

9. The method of installing a golf bell onto a golf flag pole of claim 7, further comprising the step of inserting said flag pole ferrule into the earth.

10. An enhanced golf green, having:

a golf green;

golf green earth beneath said golf green;

a golf ball having a golf ball diameter and configured to roll upon said golf green;

a hole formed through said golf green and within said golf green earth;

a cup inserted into said hole;

a longitudinally extensive flag pole defining a flag pole longitudinal axis and having a flag pole top and a flag pole bottom distal to said flag pole top, and a flag pole outside diameter around said flag pole longitudinal axis; and a flag adjacent and affixed to said top of said flag pole;

wherein the improvement comprises a golf bell having:

a longitudinally extensive spacer tube defining a spacer tube longitudinal axis and terminating at a spacer tube upper end and at a spacer tube lower end distal to said spacer tube upper end and a spacer tube outside diameter around said spacer tube longitudinal axis, said spacer tube circumscribing said flag pole;

a bell having a bell body circumscribing said flag pole; and a bell hole passing through said bell body that is larger in diameter than said flag pole outside diameter and smaller in diameter than said spacer tube outside diameter;

said bell resting upon said spacer tube upper end with said bell hole circumscribing said flag pole and suspended above said golf green and defining a gap therebetween smaller than said golf ball diameter;

said bell configured to ring and thereby provide an indication that said golf bell has been struck when impacted by said golf ball; and a flag pole ferrule terminating said flag pole bottom and engaged with said cup, said flag pole ferrule and said cup aligning said flag pole with a center axis of said hole, said spacer tube lower end engaged with said flag pole ferrule distal to said flag.

11. An enhanced golf green, having:

a golf green;

golf green earth beneath said golf green;

a golf ball having a golf ball diameter and configured to roll upon said golf green;

a hole formed through said golf green and within said golf green earth;

a cup inserted into said hole;

a longitudinally extensive flag pole defining a flag pole longitudinal axis and having a flag pole top and a flag pole bottom distal to said flag pole top, and a flag pole outside diameter around said flag pole longitudinal axis; and a flag adjacent and affixed to said top of said flag pole;

wherein the improvement comprises a golf bell having:

a longitudinally extensive spacer tube defining a spacer tube longitudinal axis and terminating at a spacer tube upper end and at a spacer tube lower end distal to said spacer tube upper end and a spacer tube outside diameter around said spacer tube longitudinal axis, said spacer tube circumscribing said flag pole;

a bell having a bell body circumscribing said flag pole; and a bell hole passing through said bell body that is larger in diameter than said flag pole outside diameter and smaller in diameter than said spacer tube outside diameter;

said bell resting upon said spacer tube upper end with said bell hole circumscribing said flag pole and suspended above said golf green and defining a gap therebetween smaller than said golf ball diameter;

said bell configured to ring and thereby provide an indication that said golf bell has been struck when impacted by said golf ball; and a spacer washer, said spacer tube lower end engaged with and supported by said spacer washer;

wherein said spacer washer spans said hole and rests upon said golf green.

12. An enhanced golf green, having:

a golf green;

golf green earth beneath said golf green;

a golf ball having a golf ball diameter and configured to roll upon said golf green;

a hole formed through said golf green and within said golf green earth;

a cup inserted into said hole;

a longitudinally extensive flag pole defining a flag pole longitudinal axis and having a flag pole top and a flag pole bottom distal to said flag pole top, and a flag pole outside diameter around said flag pole longitudinal axis; and a flag adjacent and affixed to said top of said flag pole;

wherein the improvement comprises a golf bell having:

a longitudinally extensive spacer tube defining a spacer tube longitudinal axis and terminating at a spacer tube upper end and at a spacer tube lower end distal to said spacer tube upper end and a spacer tube outside diameter around said spacer tube longitudinal axis, said spacer tube circumscribing said flag pole;

a bell having a bell body circumscribing said flag pole; and a bell hole passing through said bell body that is larger in diameter than said flag pole outside diameter and smaller in diameter than said spacer tube outside diameter;

said bell resting upon said spacer tube upper end with said bell hole circumscribing said flag pole and suspended above said golf green and defining a gap therebetween smaller than said golf ball diameter;

said bell configured to ring and thereby provide an indication that said golf bell has been struck when impacted by said golf ball;

wherein said bell has a bowl shape, and a rim distal to said bell hole; and wherein said bell rim is configured to redirect said golf ball from horizontal travel across said golf green to include a vertical component, thereby lifting said golf ball up and off of said golf green upon sufficient impact velocity with said bell rim.

* * * * *